US005348155A

United States Patent [19]

Ishiwa

[11] Patent Number: 5,348,155

[45] Date of Patent: Sep. 20, 1994

[54] PLASTIC FILM BAG WITH AN INFLATED PATTERN

[75] Inventor: Takuzo Ishiwa, Tokyo, Japan

[73] Assignee: Ringston Co., Ltd., Tokyo, Japan

[21] Appl. No.: 43,801

[22] PCT Filed: May 28, 1991

[86] PCT No.: PCT/JP91/00710

§ 371 Date: Apr. 7, 1993

§ 102(e) Date: Apr. 7, 1993

[87] PCT Pub. No.: WO92/21264

PCT Pub. Date: Dec. 10, 1992

[51] Int. Cl.[5] ..... B65D 73/00; B65D 30/10

[52] U.S. Cl. ..... 206/457; 383/3

[58] Field of Search ..... 206/457; 383/907, 24, 383/25, 72, 75, 3; D3/44, 42, 45, 46; D9/305, 310–312

[56] References Cited

U.S. PATENT DOCUMENTS

| | | | |
|---|---|---|---|
| D. 35,944 | 6/1902 | Myers | D9/312 |
| D. 38,482 | 3/1907 | Kahn | D3/45 |
| D.74,122 | 12/1927 | Royal | D9/312 |
| D.74,526 | 2/1928 | Sporn | D3/46 |
| D. 175,233 | 7/1955 | Reichman | D3/46 |
| D. 177,812 | 5/1956 | Hyman | D3/46 |
| D. 199,544 | 11/1964 | Bryant | D3/46 X |
| 1,127,384 | 2/1915 | Adams | 383/25 X |
| 1,533,428 | 4/1925 | Kittleson | 383/907 X |
| 1,696,138 | 12/1928 | Day et al. | 383/25 X |
| 2,175,319 | 10/1939 | Rubenstein | 206/457 X |
| 3,270,790 | 9/1966 | Clark | 383/24 X |
| 3,867,971 | 2/1975 | Hazan | 206/457 X |
| 4,384,602 | 5/1983 | Ores | 383/3 X |
| 5,255,834 | 10/1993 | Bendersky | 206/457 X |

FOREIGN PATENT DOCUMENTS

| | | | |
|---|---|---|---|
| 2824397 | 12/1978 | Fed. Rep. of Germany | 383/3 |
| 54-0136985 | 10/1979 | Japan . | |
| 60-0006247 | 2/1985 | Japan . | |
| 62-0126120 | 8/1987 | Japan . | |
| 63-0018333 | 5/1988 | Japan . | |
| 0004061 | of 1915 | United Kingdom | 383/25 |
| 0704493 | 2/1954 | United Kingdom | 383/3 |
| 2157552 | 10/1985 | United Kingdom | 383/3 |

*Primary Examiner*—Paul T. Sewell
*Assistant Examiner*—Ted Kavanaugh
*Attorney, Agent, or Firm*—Kanesaka & Takeuchi

[57] ABSTRACT

A plastic film bag with an inflated pattern of the invention is formed of a bag section for retaining an article therein, an inflating portion of a pattern sealingly attached to the bag section and an inflating device for inflating the inflating portion. When the inflating portion is inflated by fluid through the inflating device, the inflating portion becomes three-dimensional and projects outwardly from the outer surface of the bag section without substantially reducing a space inside the bag section.

8 Claims, 3 Drawing Sheets

PLASTIC FILM BAG WITH AN INFLATED PATTERN

TECHNICAL FIELD

The present invention relates to a packaging bag or modified bag formed of a plastic film, such as polyethylene, and more particularly to a bag wherein the entire periphery of a pattern drawn on the bag is heat-sealed and the pattern portion is inflated with air.

BACKGROUND OF THE TECHNIQUE

Heretofore, a packaging bag and a shopping bag made of polyethylene have been formed such that two sheets of plastic films for a front side and a back side are laminated and heat-sealed along the periphery thereof, and except this, a pattern is printed on a surface of the bag, and carrying handles for carrying the bag are fixed. Therefore, such a plastic film bag is familiar to people, so that even if the bag has a unique pattern, it does not attract attention of people, thus, for the purpose of sales promotion, there has been a problem in creating novelty. Further, a bag made of cloth or leather, as disclosed in Japanese Utility Model Publication Sho 58-29951, is formed to resemble a mascot doll or stuffed doll so as to create novelty and a toy-like effect to satisfy children's desire, but much time and labor are required for selecting a material similar to a fur of an animal, sewing the bag in a shape of an animal, and, stuffing cotton into the bag, which results in a high cost.

Accordingly, in order to change bags to something new, a raw material of plastic film is changed, or an inflatable portion is provided to a packaging bag, such as an inflatable packaging bag as disclosed in Japanese Patent Application Laid-Open Publication Sho 54-136985, and a bag also serving as a portable cushion as disclosed in Japanese Utility Model Application Laid-Open Publication Sho 62-126120. However, in these bags, functions, such as use of heat insulation or a bag serving also as a cushion are mainly considered important.

DISCLOSURE OF THE INVENTION

A packaging bag or a modified bag of polyethylene, it has a structure such that a whole or a portion of a pattern drawn on the bag is composed of two sheets for a front side and a back side, by adding a material as in or different from that of the bag, and the entire periphery of the pattern is heat-sealed to surround therearound. Simultaneously with, or before or after the heat-sealing, an air inflating device, such as a mouth with a check valve, is provided to inflate the sealed portion by air.

Also, a portion to be inflated is made small and is provided adjacent to a body of the bag and the pattern is drawn to be projected from the body outwardly to obtain a good effect.

Further, the portion to be inflated may be formed of an extended portion of the film composing the body of the bag so that the portion to be inflated can be produced at the same time of forming the body of the bag.

BEST MODES FOR EMBODYING THE PRESENT INVENTION

Figure 1:
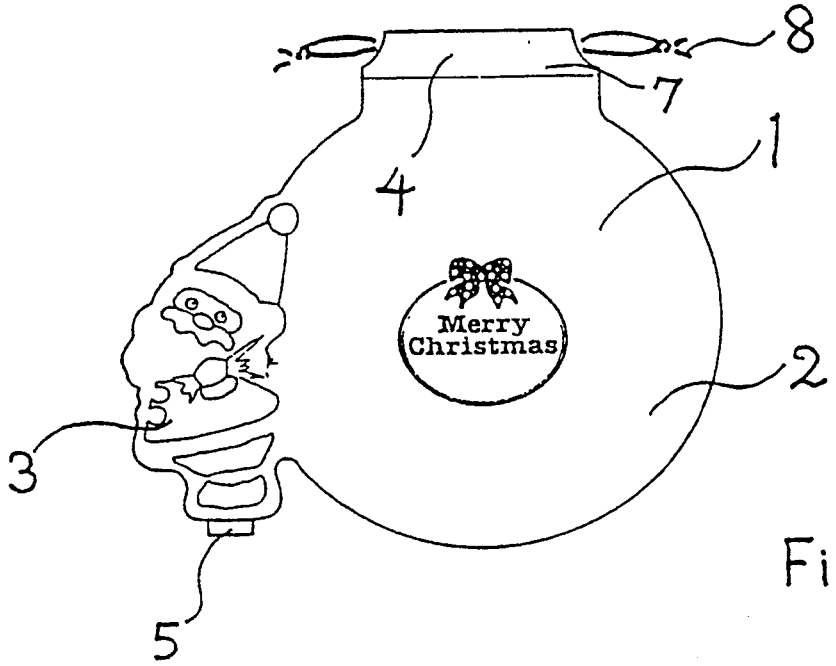
FIG. 1 is a plan view showing one embodiment of the present invention.
Figure 2:
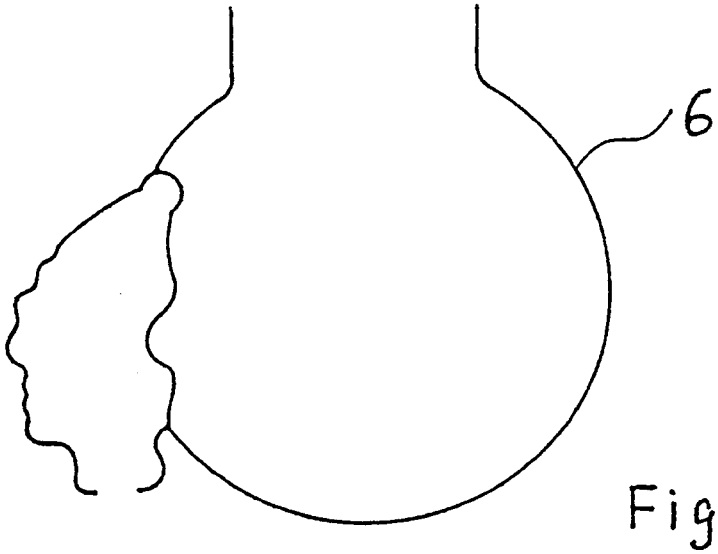
FIG. 2 is a plan view of heat sealing lines thereof.

In explaining the invention with reference to the drawings, FIG. 1 is a plan view showing an embodiment, and FIG. 2 is a plan view of heat sealing lines thereof. A modified bag 1 shown in the drawing is formed such that a contour of a body 2 of the bag for containing articles therein and a pattern 3 of Santa Clause adjacent to the body 2, which are drawn on two laminated sheets of polyethylene films, are heat sealed except for an opening 4 of the bag and a portion to be provided with a mouth 5 with a check valve, and the outside portions thereof are cut off.

Then, the bag is completed by providing a string-fixing portion 7 at the opening 4 of the bag, a string 8, and the mouth 5 with the check valve at the Santa Clause, which is a thin-flat type tube and is usually used in a polyethylene balloon.

If air is blown through the mouth 5 with the check valve by means of a straw, since the modified bag 1 comprises two separate bags as shown in FIG. 2, the sealed pattern 3 of Santa Clause is inflated and becomes like a stuffed doll, and Santa Clause appears to carry the body 2 stuffed with articles, so that the bag becomes more unique and humorous.

When air is not blown into the pattern 3 of Santa Clause, the Santa Clause's portion flutters like a tag fixed to the bag, and is flimsy, and further it becomes creased by the effect of the body 2 stuffed with articles.

Further, when a border between the pattern 3 of Santa Clause and the body 2 of the bag is removed to form a single bag, articles are not always stuffed in the portion of the pattern 3 of Santa Clause to inflate the portion well, but rather, the articles do not enter into the small side room in most cases, and it is difficult to produce loveliness like a pretty stuffed doll with only the pattern 3.

Incidentally, as a production method, the same effect can be obtained in a manner that the modified bag 1 is first cut off from a film, two sheets of the cut-off films are laminated, the mouth 5 with a check valve is disposed therebetween and the periphery is heat-sealed at a time.

Figure 3:
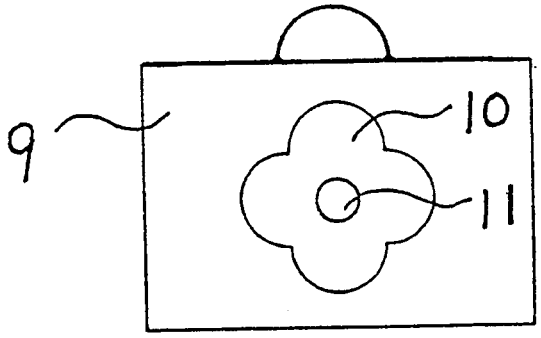
FIGS. 3, 4, and 9 are plan views showing other embodiments.

FIG. 3 shows a handbag 9 at the central portion of which a flower pattern 10 is drawn, wherein another polyethylene film is inserted into an interior of the handbag and a contour of the flower pattern 10 is heat-sealed in order not to be fuse-bonded to the other back side of the handbag. While omitted in the drawing, if air is blown through a mouth with a check valve which is provided at the same time of heat sealing, the flower pattern 10 is inflated to be three-dimensional.

However, when a large flower pattern like this is drawn on the body of the handbag and inflated, the body 2 of the handbag is crushed by the inflated flower pattern and becomes narrow, and it is difficult to put articles into the body 2, which is an obstacle in practical use. Therefore, it is necessary to fuse-bond a center portion 11 of the flower to not allow the flower to inflate too much, or to form the flower small.

Figure 4:
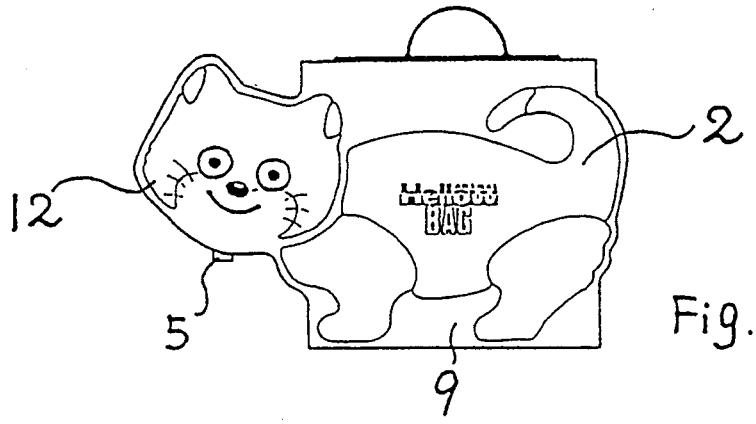

A positional relation between a drawn pattern and a body of a bag is considered from the handbag 9 shown in FIG. 4 and sealing lines 6 shown in FIGS. 5 through 8. The films may be folded or the bag may be provided with a width forming member to form a bottom, but in order to be easily understood, sealing lines are drawn.

Figure 5:
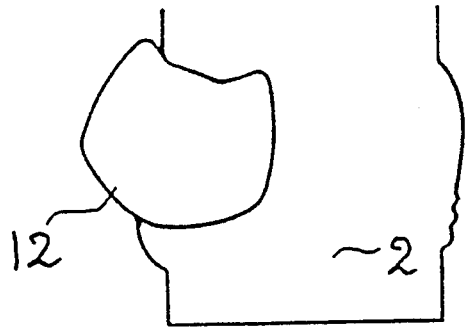
FIGS. 5–8 are plan views showing neat sealing lines of modifications of the embodiment shown in FIG. 4.
Figure 6:
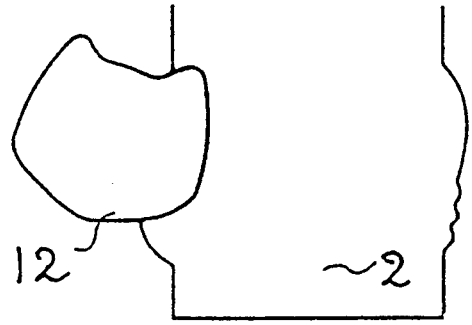
Figure 7:
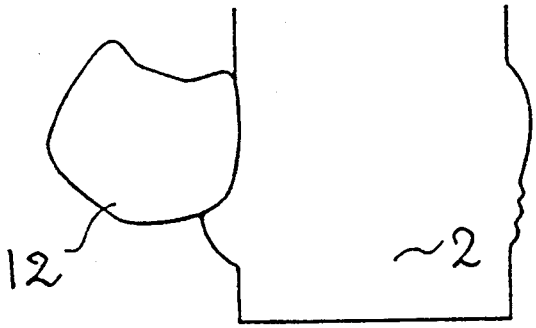
Figure 8:
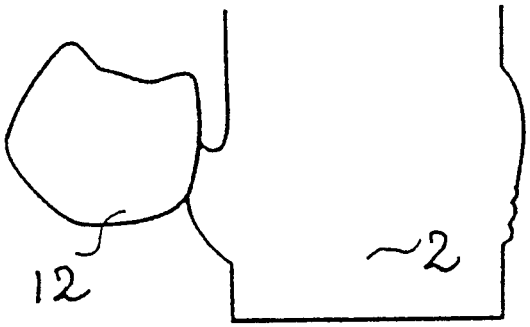

As shown in FIG. 5, when a portion surrounded by border lines of a head portion 12 of a cat united with the body 2 the bag is large, i.e., connected with a large area, the 2 of the bag is easily creased, and causes an obstacle to put articles into the body of the bag. While, as shown in FIGS. 7 and 8, when the head portion 12 and the body 2 of the bag are separated, such an obstacle can be removed, but at this time, the head portion 12 of the cat flutters and is unstable. Therefore, as shown in FIG. 6, when connected with a small area, the pattern is clearly presented and the head portion 12 and the body 2 do not badly affect each other. The flower pattern mentioned before may be fuse bonded at the center portion 11 thereof without fuse bonding the periphery thereof.

After the head portion 12 of the cat is formed another polyethylene film, it may be fuse bonded to the periphery of the body of the bag, or the head portion 12 may be formed of an extended portion of the same film as that the body of the bag. Accordingly, the head portion can be completed at the same time as the body, and the fixing position can be made accurate. Further, the head portion may be fixed not only to the side portion of the bag but also one side (a back side in the drawing) near the opening of the bag 13 as shown in FIG. 9.

Figure 9:
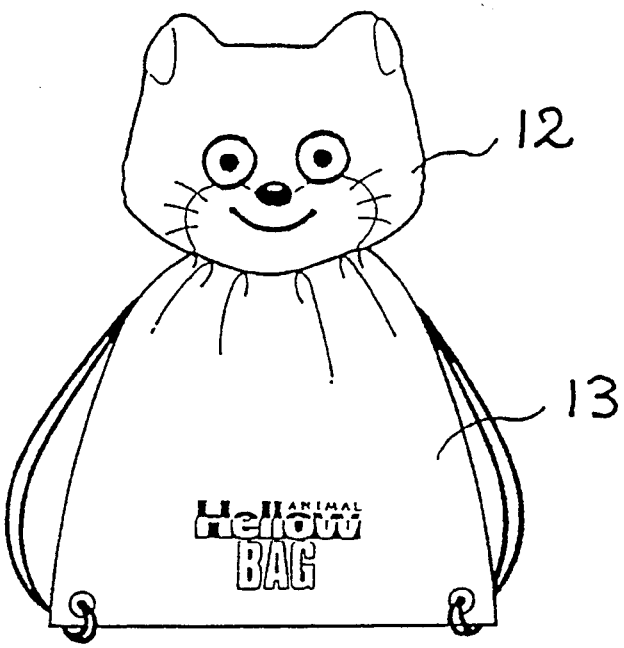

As shown in FIG. 9, although the pattern is irrespective to the bag, it is interesting to show such that the cat is put into the bag. Thus, according to the present invention, various shapes of bags can be produced based on ideas.

Incidentally, as a method for inflating patterns, in addition to providing a mouth with a check valve, a device for generating carbonic acid gas, such as sodium bicarbonate and a citric acid aqueous solution may be sealed therein.

POSSIBILITY OF INDUSTRIAL USE

Packaging bags and shopping bags of polyethylene which Rave been familiar to people become attractive by inflating patterns drawn on the bags to produce three-dimensional patterns or causing the patterns to project from the bags so that the bags can be fully used in sales promotion as well as it is easy to identify where bags with the personal goods are placed. Therefore, the bags can generally be sold for bags suitable to carry in traveling.

Further, if an inflated mascot doll or koala doll attached to a shoulder bag, or has its head out of the shoulder bag, the bag exhibits a toy-like effect, so that such bags can be used as packaging bags of gifts for children. Further, these bags can be carried to a hiking, can be sold at a toyshop or an amusement park. These bags not occupy a large space to store since they are inflated by purchasers.

Furthermore, since patterns to be inflated can be formed at the same time as the body of the bag by means of heat sealing, the bags can be manufactured in a simple manner and at an inexpensive cost, so that the effects as described above can be further increased.

What is claimed is:

1. A plastic film bag with an inflated pattern comprising:

a bag section for retaining an article therein and having an outer surface;

an inflating portion of a pattern sealingly attached to said bag section for allowing the inflating portion to substantially project outwardly from the outer surface of the bag section; and an inflating device attached to said inflating portion of the pattern so that when the inflating portion is inflated by fluid through the inflating device, the inflating portion becomes three-dimensional and projects outwardly from said outer surface of the bag section without substantially reducing a space inside the bag section.

2. The plastic film bag of claim 1, wherein said inflating portion of the pattern is formed of at least one plastic film sheet, and attached to the bag section, said inflating portion having a sealing line to surround an entire periphery of said pattern except an opening of said inflating device.

3. The plastic film bag of claim 2, wherein said baa section and the inflating portion are integrally connected together and formed of two sheets, said inflating portions of the two sheets being laminated and sealed together by the sealing line,

4. The plastic film bag of claim 3, wherein said inflating portion of the pattern is attached to said bag section so that when said inflating portion is inflated, the inflating projects laterally outwardly from said bag section.

5. The plastic film bag of claim 2, wherein said inflating portion of the pattern is formed on an extended portion of the sheet becoming said bag section so that said inflating portion is formed at the same time of forming said bag section.

6. The plastic film bag of claim 1, wherein said inflating portion is integrally formed with the bag section and is located at one lateral side of the bag section to project laterally outwardly from the bag section.

7. The plastic film bag of claim 6, wherein said bag section includes an inlet for a bag, said inflating portion being attached to one side of the inlet.

8. The plastic film bag of claim 1, wherein said inflating portion is smaller than the bag section, and expands outwardly from the bag section.

* * * * *